United States Patent [19]

Wyman

[11] 4,430,239

[45] Feb. 7, 1984

[54] FERROFLUID COMPOSITION AND METHOD OF MAKING AND USING SAME

[75] Inventor: John E. Wyman, Lexington, Mass.

[73] Assignee: Ferrofluidics Corporation, Nashua, N.H.

[21] Appl. No.: 464,480

[22] Filed: Feb. 7, 1983

Related U.S. Application Data

[63] Continuation-in-part of Ser. No. 313,654, Oct. 21, 1981, abandoned.

[51] Int. Cl.[3] ..... H01F 10/10

[52] U.S. Cl. ..... 252/62.51; 252/62.52; 252/62.53

[58] Field of Search ..... 252/62.51 R, 62.52, 252/62.53

[56] References Cited

U.S. PATENT DOCUMENTS

| | | | |
|---|---|---|---|
| 3,531,413 | 9/1970 | Rosensweig | 252/62.51 R |
| 3,700,595 | 10/1972 | Kaiser | 252/62.56 |
| 3,764,540 | 10/1973 | Khalafalla et al. | 252/62.55 |
| 3,843,540 | 10/1974 | Reimers et al. | 252/62.52 |
| 3,917,538 | 11/1975 | Rosensweig | 252/62.51 R |
| 4,208,294 | 6/1980 | Khalafalla et al. | 252/62.52 |
| 4,285,801 | 8/1981 | Chiang | 204/299 R |
| 4,315,827 | 2/1982 | Bottenberg et al. | 252/62.51 R |
| 4,333,988 | 6/1982 | Yamada et al. | 428/900 |

FOREIGN PATENT DOCUMENTS

| | | | |
|---|---|---|---|
| 1089293 | 3/1955 | France | 252/62.52 |
| 1236393 | 6/1960 | France | 252/62.53 |
| 705050 | 3/1954 | United Kingdom | 252/62.52 |

*Primary Examiner*—F. Edmundson

*Attorney, Agent, or Firm*—Richard P. Crowley

[57] ABSTRACT

A stable liquid composition which comprises a colloidal dispersion of finely-divided, magnetic particles in a liquid polar carrier and a dispersing amount of a surfactant, which surfactant comprises a phosphoric acid ester of a long-chain alcohol, the alcohol compatible with the polar carrier, to provide a stable ferrofluid composition.

29 Claims, No Drawings

FERROFLUID COMPOSITION AND METHOD OF MAKING AND USING SAME

REFERENCE TO PRIOR APPLICATION

This patent application is a continuation-in-part application of U.S. patent application Ser. No. 313,654, filed Oct. 21, 1981, now abandoned.

BACKGROUND OF THE INVENTION

Ferromagnetic liquids commonly are referred to as ferrofluids and typically comprise a colloidal dispersion of finely-divided magnetic particles, such as iron, $Fe_2O_3$ (hematite), magnetite and combinations thereof, of subdomain size, such as, for example, 10 to 800 Angstroms, and more particularly 50 to 500 Angstroms, dispersed in a liquid through the use of a surfactant-type material. Typically, ferrofluids are remarkedly unaffected by the presence of applied magnetic fields or by other force fields, and the magnetic particles remain uniformly dispersed throughout the liquid carrier. Ferrofluid compositions are widely known, and typical ferrofluid compositions are described, for example, in U.S. Pat. No. 3,700,595, issued Oct. 24, 1972, and U.S. Pat. No. 3,764,540, issued Oct. 9, 1973, while a particular process for preparing such ferrofluid compositions is described more particularly in U.S. Pat. No. 3,917,538, issued Nov. 4, 1975, which describes a grinding or ball-mill technique for preparing ferrofluid compositions, and U.S. Pat. No. 4,019,994, issued Apr. 26, 1977, describing more particularly a precipitation technique for preparing ferrofluid compositions.

Ferrofluids have been suggested to be prepared using a wide variety of liquid carriers. However, current state-of-the-art ferrofluids typically employ a hydrocarbon carrier or, for example, a diester liquid, such as di(2-ethylhexyl)azelate. Liquid ferrofluids typically comprise a dispersion of colloidal magnetite stabilized by a fatty-aliphatic-acid surfactant in a hydrocarbon-liquid carrier, such as, for example, the use of an oleic-acid-type surfactant. The diester ferrofluids have found use in audio-voice-coil-damping and inertia-damping apparatus and for use in bearings and exclusion and vacuum seals. Such prior-art ferrofluid compositions often have undesirable high viscosities for the amount of magnetization required for some applications, and so it is desirable to provide stable ferrofluid compositions of a liquid polar carrier having low viscosities at higher solids content and gauss levels.

SUMMARY OF THE INVENTION

My invention concerns a stable ferrofluid composition and a method of preparing and using such composition. In particular, my invention relates to a stable, low-viscosity, ferrofluid composition employing a liquid polar carrier and a phosphated, alcohol-ester dispersing agent for colloidal magnetic particles.

I have found that stable ferrofluid compositions may be prepared through the dispersing of colloidal particles of magnetic particles, such as magnetite, in various liquids with high boiling points, through the use of phosphoric acid esters of long-chain alcohols as dispersing agents, to produce ferrofluid compositions with low viscosities and with high solids content and a higher gauss than ferrofluid compositions prepared with conventionally employed dispersants or surface-active agents. My ferrofluid compositions are suitable for use in the voice coils of loudspeakers, for use with exclusion and vacuum seals, for bearings and for other purposes. In particular, my ferrofluid compositions permit low viscosities as low as about 50 cps at 200 gauss and as high as 2000 cps; for example, 500 cps, and high gauss; for example, about 50 to 775 gauss and more particularly 200 to 500 gauss; for example, 675 gauss at a viscosity of 1900 cps. Typically, my ferrofluid composition may comprise from about 50 to 500 cps in viscosity and from about 400 to 700 gauss, and often has a solids content; that is, a magnetic particle content, of from about 1% to 10% by volume, and more particularly 3% to 8% by volume.

I have discovered that phosphated alcohol dispersants, which have a phosphoric acid polar group which forms a strong, stable bond to magnetic or magnetite particles, and which dispersant has a nonpolar group which is compatible with the carrier used in a continuous phase; that is, the long-chain alcohol compatible with the liquid polar carrier, provides for a stable ferrofluid composition of low viscosity and high magnetization. I have discovered that acid phosphoric esters are strongly adsorbed on the surfaces of magnetic particles, and that the ester-alcohol portion of the phosphoric acid may be selected, so that it is compatible with the particular carrier liquid used as a continuous phase in the ferrofluid, so that a stable colloidal suspension is formed in the ferrofluid. Surprisingly and unexpectedly, the resulting ferrofluid composition, with the dispersed magnetite particles, with the phosphoric acid ester as a dispersant, has an unexpectedly low viscosity as low as 50 cps, with high solids content and good magnetization.

The phosphoric acid ester dispersing agents useful in the preparation of the ferrofluid composition of my invention comprise those phosphoric acid esters or monoesters and diesters formed by the reaction and esterification of a long-chain, saturated or unsaturated alcohol with phosphoric acid. The alcohol portion of the dispersing agent is selected to be compatible with the particular liquid carrier of the ferrofluid composition. For example, the long-chain alcohol may comprise a $C_6$–$C_{14}$, and more particularly a $C_6$–$C_{12}$, alcohol, such as a saturated or an unsaturated aliphatic or aromatic alcohol; for example, but not limited to, 2-ethylhexyl alcohol; oleyl alcohol; octyl alcohol; linear or branched-chain aliphatic alcohols; decyl alcohol and particularly the $C_6$–$C_{12}$ alkanols. For example, in the selection of the alcohol to be esterified with the phosphoric acid and to form the long-chain alcohol portion of the dispersing agent, the alcohol should be compatible with the liquid carrier and could be, for example, a fluorinated alcohol compatible with a fluorocarbon liquid, or a polyethoxylated ethanol dimethylsiloxane polymer compatible with a dimethylsiloxane polymer or liquid. Thus, the alcohol selected may be a substituted alcohol containing particular groups, such as halo groups, such as chloro or fluoro groups or siloxane groups, to make the alcohol portion compatible or more compatible with the particular liquid carrier to be employed in the ferrofluid composition. The phosphoric acid group forms the polar group of the dispersing agent and is a substantive to the iron or iron-oxide surface of the magnetite particles.

In one particular embodiment, I have discovered that phosphated alkoxylated alcohols are particularly useful as dispersing agents, as being water-soluble and which provide for a phosphate polar group which strongly adsorbs to the magnetite-particle surface, when added to a water slurry of the magnetite particles, while the alkoxylated alcohol tail group of the dispersing agent provides for compatibility in a liquid polar carrier, such as an organic polar liquid used as a liquid carrier of the ferrofluid composition. The phosphated alkoxylated alcohol dispersing agents useful in my invention may be represented by the structural formula as follows:

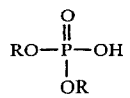

where at least one R radical is a monovalent radical having the formula:

$$C_nH_{2n+1}O\text{-}(\text{-}R_1\text{—}O\text{-})_x\text{-}R_1\text{—}O\text{—}$$

and the other R is hydrogen to form the monoester or, where both R radicals have the structural formula, to form the diester, and wherein n is a number from 6 to 18; for example, 6 to 12, and x is a number from 0 to 10; for example, 1 to 5, and $R_1$ is an alkylene, such as a dimethylene (—$CH_2$—$CH_2$—) or trimethylene (—$CH_2CH_2CH_2$—), radical or propylene $$(CH_3CH\text{—}CH_2)$$

radical. Thus, the acid phosphoric acid esters useful in the ferrofluid composition may comprise the monoesters or diesters of the tribasic phosphoric acid as phosphated alcohols or as acid alkoxylated alcohol phosphate esters, where alkoxylation of the alcohol is optional in one embodiment.

The formula as illustrated provides for a long-chain alcohol tail group coupled with an alkylene oxide group derived from propylene or ethylene oxide, such as an ethoxylated or propoxylated group, to the polar phosphoric acid group. Typical alkoxylated long-chain alcohol phosphoric acid esters suitable as dispersing agents would include: propoxylated and ethoxylated 2-ethylhexanol, which is a phosphated linear alcohol ethoxylate; ethoxylated oleyl alcohol phosphoric acid ester, as well as phosphated phenoxy alkylated alkanols, such as phosphated $C_6$–$C_{12}$ phenoxy-polyethyleneoxy or propyleneoxy ethanol or propanol, such as a phosphated nonylphenoxy polyethyleneoxy ethanol.

The phosphated alkoxylated alcohol dispersing agents useful in the invention typically are water-soluble and adsorbed strongly to the magnetite particle surface, when added to a water slurry. The coated magnetic particles still in water, or optionally a water-miscible solvent, such as alcohol, acetone or the like, such as a volatile organic solvent to form suspensions, are often added to a high-boiling organic polar carrier, such as a diester or triester carrier, such as di(2-ethylhexyl)azelate. The suspension is heated to drive off the water or the volatile solvent, to form a stable colloidal suspension of the phosphated alkoxylated-alcohol-coated particles in the particularly selected liquid carrier. It has been found that, in the absence of the phosphated alkoxylated alcohol, the magnetite particles do not form a stable dispersion, but rather rapidly settle out from the polar carrier.

It has been found that the magnetic-coated particles form a stable colloidal suspension of ferrofluid in a relatively polar carrier liquid, typically, for example, those organic liquids useful as plasticizers for polymers, such as vinyl-chloride resins, and which liquid carriers would include, but not be limited to: diesters; triesters; polyesters of saturated hydrocarbon acids, such as a $C_6$–$C_{12}$ acid; phthalates, such as dioctyl and dialkyl phthalates; and trimellitate esters, citrate esters and particularly diesters and triesters as represented by di(2-ethylhexyl)azelate, diisodecyl adipate and triesters, such as tributyl citrate, acetyl tributyl citrate and trimellitate esters, such as tri(n-octyl/n-decyl) or other alkyl trimellitates. Other liquid polar carrier fluids include, but are not limited to, derivatives of phthalic acid, with emphasis on dialkyl and alkylbenzyl orthophthalates, phosphates, including triaryl, trialkyl and alkylaryl phosphates, epoxy derivatives, including epoxidized soybean oil, epoxidized tall oil, dialkyl adipates, polyesters of glycols; for example, adipic, azelaic and phthalic acids with various glycols, trimellitates, such as trialkyl trimellitates, glycol dibenzoates, pentaerythritol derivatives, chlorinated liquid paraffin, and in particular the $C_8$, $C_9$ and $C_{10}$ phthalates, such as di(2-ethylhexyl)phthalate, diisononyl phthalate, diisodecyl phthalate and di(2-ethylhexyl)tere phthalate.

It also has been discovered that the phosphoric acid esters useful as dispersing agents in the invention also form stable ferrofluid compositions containing magnetite particles, wherein the magnetite particles previously have been coated with a second dispersant, such as a fatty-acid dispersant, such as oleic acid. For example, such fatty-acid or other known surfactant and dispersing agents for ferrofluids, such as oleic acid, bond strongly to magnetite by the carboxylated group, and the oleic-acid-coated particles form stable colloidal dispersions in non-polar liquid carriers, such as aliphatic hydrocarbon fluids, such as kerosene. However, these fatty-acid-coated magnetic particles will not form a stable colloidal suspension in a polar liquid carrier, such as the diesters or triesters or other polar carriers cited. However, the fatty-acid-coated, such as the oleic-acid-coated, magnetite particles have been discovered to form stable colloidal suspensions in a polar carrier, where phosphoric acid alcohol esters as dispersing agents are added to the slurry. Thus, the dispersing agents of the invention may be employed as dispersing agents for colloidal magnetic particles, where the liquid carrier is a polar carrier, or where the magnetic particles have been coated previously with a fatty-acid or other known second dispersing agent. The phosphoric acid alcohol esters may be used also to form a stable ferrofluid with the coated magnetite particles.

It has been discovered that the use of strong acid-type surfactants or dispersing agents, particularly when used in excess of usual or normal dispersing amounts to disperse the magnetite or magnetic particles of the ferrofluid, are advantageous in reducing materially the viscosity of the ferrofluid. Generally an excess of the acid phosphate ester, ie, greater than the stoichiometric amount used for dispersion, is required, for example, an excess of over 10 percent by weight such as 10–90% by weight, for example 30–60%.

In particular, it has been found that acid phosphate acid esters as dispersing agents tend to dissolve the smaller magnetic particles of the ferrofluid and to shift the particles distribution from log-normal distribution toward and approaching a Gaussian distribution. Although not wished to be bound by any particular theory or explanation, it is believed that the smaller magnetic particles having higher surface energies, for example, less than about 80 Angstrom in size and particularly less than 60, such as in the 40 to 60 Angstrom particles range of the ferrofluid, are preferentially dissolved by the strong acid surfactant or dispersing agent. The acid surfactant or dispersing agent after coating the surface of the magnetic particles preferentially attach and dissolve the smaller particles. These smaller magnetic particles are present in minor quantities such as generally less than 10 percent by weight, such as less than 5 percent by weight of the ferrofluid and generally are present whether the ferrofluid is prepared by prior grinding, or other techniques. These smaller particles tend to contribute to the viscosity of the ferrofluid, but not materially to the magnetization of the ferrofluid. Thus, the dissolving of the smaller particles does not materially alter the average particle size of the magnetic particles of the ferrofluid or the magnetization, but provides for substantially decreased viscosity properties of the ferrofluid. The decrease in viscosity of the ferrofluid in the absence of the smaller particles generally is material such as 200 cps or greater.

In the practice of this invention, desireable acid type surfactants would include the strong acid phosphate esters used in the ferrofluid of the invention.

While the alkoxylated phosphate ester surfactant are particularly useful with polar liquid carrier of the ferrofluid, it has also been discovered that fatty alcohol phosphate esters are useful with liquid nonpolar carriers. For example, fatty alcohol phosphate acid esters such as derived from $C_8$–$C_{20}$ fatty alcohols are compatible with synthetic and natural hydrocarbon lubricants used as nonpolar liquid carriers. Suitable fatty alcohols used to prepare the esters would include and comprise, but not be limited to, high molecular weight fatty alcohols prepared by the oxo or Ziegler processes, such as octyl, decyl, lauryl, cetyl and stearyl alcohols. Nonpolar liquid carriers useful with such fatty alcohol phosphate ester include, but are not limited to, poly alphaolefin liquids, paraffinic type oils, and synthetic hydrocarbon lubricants having a very low freezing, for example, points of about −90° F. or lower.

The utility of any phosphoric acid alcohol ester in preparing stable ferrofluid compositions is easily determined, by mixing the proposed phosphoric acid ester with the proposed carrier liquid, in order to determine their compatibility. If the dispersing agent selected is compatible with the liquid polar carrier, a single homogeneous liquid will result on mixing which will not separate into two phases over the temperature range from a freezing point of the solution to the boiling point or decomposition temperature of the liquid carrier or of the phosphoric acid alcohol ester dispersing agent. Where the particular phosphoric acid alcohol ester is found compatible, then the ester may be employed as a dispersing agent in accordance with this invention, and will produce stable colloidal dispersions of magnetic particles with low viscosity and high solids content and high gauss.

The magnetic particles employed in my ferrofluid composition may be those magnetic particles prepared either by grinding, precipitation or otherwise, but typically are finely-divided magnetizable particles of a colloidal size; for example, generally less than 800 Angstroms; for example, 20 to 500 Angstroms and more particularly 50 to 150 Angstroms, dispersable in a liquid carrier. The magnetic particles are usually recognized as magnetite, gamma iron oxide, chromium dioxide, ferrites and similar materials, and which material also may include various elements of metallic alloys. The preferred materials are magnetite ($Fe_3O_4$) and gamma and alpha iron oxide ($Fe_2O_3$), wherein the magnetic particles are present usually in an amount of from 1% to 20%; for example, 1% to 10% or 3% to 8%, by volume of the composition.

Phosphated dispersant agents employed in preparing the ferrofluid composition may be present in an amount sufficient to provide the desired colloidal dispersion stability to the ferrofluid composition, and more typically are used in a ratio of surfactant to magnetic particles of from about 1:1 to 20:1 by volume; for example, 1:1 to 10:1 by volume. If desired, the dispersing agents may be used alone or in conjunction with other dispersing agents or additive fluids. As set forth, the dispersing agent may be employed directly with the magnetic particles or with magnetic particles previously containing adsorbed fatty-acid or other surfactants or dispersants on the magnetic particles.

My stable ferrofluid composition may be prepared, for example, by forming a colloidal suspension with the magnetite particles, either by precipitation or grinding techniques, through forming a suspension of the magnetite particles with a dispersing agent in water or water with a volatile or water-soluble or water-miscible solvent, such as an alcohol or acetone. The slurry of the phosphated, dispersing-agent-coated magnetite particles then may be added to the selected liquid polar carrier, and then heated with stirring, to evaporate or otherwise to remove the volatile organic solvent and water and to recover the resulting stable ferrofluid composition.

For the purpose of illustration only, my invention will be described in connection with the preparation of certain improved low-viscosity ferrofluid compositions employing certain selected dispersing agents. However, it is recognized that those persons skilled in the art may make various changes, improvements and modifications in the ferrofluid composition and the method of preparing the same, all without departing from the spirit and scope of my invention.

DESCRIPTION OF THE EMBODIMENTS

EXAMPLE 1

Use of a phosphoric acid ester of an ethoxylated aliphatic alcohol as a dispersant for magnetite In a 600-ml beaker was placed 55.6 g of ferrous sulfate heptahydrate and 80 ml water. The slurry was stirred, until the ferrous salt had dissolved, and then 93 ml of 46° Baume ferric chloride solution were added.

In a separate 600-ml beaker were placed 120 ml of 26° Baume ammonium hydroxide and 80 ml of water. With vigorous stirring, the iron salt solution was added to the ammonia solution over a 6-minute period.

The resulting magnetite slurry was transferred into a 2-liter beaker filled to 2000 ml with cold water, and the magnetite was allowed to settle. The supernatant liquid was siphoned off, the beaker refilled with cold water and again allowed to settle. This procedure was repeated, until the ammonium salt content was reduced to about 1 mg. The slurry was then transferred to a 1-liter beaker.

Water was added to achieve a 500-ml volume, and then 50 g of a commercially available phosphoric acid ester of an ethoxylated alcohol (Dextrol OC-70, Dexter Chemical Co.) were added. About 500 ml of acetone were added, and the coated particles were allowed to settle. The supernatant liquid was drawn off and the particles were washed once more with 1 liter of acetone.

The slurry of coated magnetite was added to about 40 ml of di(2-ethylhexyl)azelate and heated with stirring to eliminate acetone and water. The resulting ferrofluid had a saturation magnetization of 513 gauss and had a viscosity of 134 centipoise.

EXAMPLE 2

Use of a phosphoric acid ester of an ethoxylated aliphatic alcohol as a dispersant for oleic-acid-coated magnetite In a 100-ml beaker was placed 222.4 g of ferrous sulfate heptahydrate, 320 ml water and 372 ml of 46° Baume ferric chloride solution. The slurry was stirred to dissolve the iron salts.

In a 4000-ml beaker was placed 320 ml water and 480 ml of 26° Baume ammonia solution. With vigorous stirring, the iron salts were added to the ammonia solution, the beaker was topped with cold water and the magnetite was allowed to settle.

The supernatant liquid was siphoned off and the beaker filled with cold water and allowed to stand until the magnetite had settled. This process was repeated, until less than 0.1 g of ammonium salts remained.

The volume of the slurry was adjusted to 2 liters with water in a 4-liter beaker, and 1.5 liters of heptane and 115 ml of oleic acid were added. The mixture was stirred for 1 hour, to coat the magnetite with oleic acid and to flush the coated magnetite into the heptane. After separation of the layers, the heptane suspension of the magnetite was placed in a shallow pan and heated with stirring, to reduce the heptane to about 700 ml volume. A total of 80 ml of a phosphoric acid ester of an ethoxylated alcohol (Dextrol OC-70) was added, followed by 200 ml of diisodecyl azelate. The slurry was then heated to 150° C. to 160° C. with stirring and was held at this temperature for 4 hours to remove water and heptane.

The fluid was refined at 90° C. for 16 hours. The resulting fluid had a saturation magnetization of 278 gauss and a viscosity of 56 centipoise.

EXAMPLE 3

Use of a phosphoric acid ester of an ethoxylated nonylphenol as a dispersant for magnetite A magnetite slurry was prepared, as described in Example 2, and was washed with water, until the ammonia salt content was reduced to 5 mg.

In a 4-liter beaker, the magnetite slurry was adjusted to 2 liters volume with water and 231 ml of a phosphoric acid ester of an ethoxylated nonylphenyl (Dextrol OC-20, Dexter Chemical Co.) were added. The slurry was stirred for 1 hour at ambient temperature. 2 liters of acetone were added, the magnetite was allowed to settle and the supernatant liquid was siphoned off. The slurry was washed with acetone, until the water content was reduced to about 15 ml.

The acetone wet slurry was added to 300 ml of a mixed normal alkyl trimellitate ester (U.S.S. Chemicals, PX-336) and heated to 150° C. to 160° C., where it was maintained for 4 hours. The fluid was refined by standing on a magnet in a 90° C. oven for 48 hours to remove large particles. The fluid had a saturation magnetization of 242 gauss and a viscosity of 252 cp.

EXAMPLE 4

Use of a phosphoric acid ester of an ethoxylated alcohol as a dispersant for oleic-acid-coated magnetite In a 1-liter beaker was placed 222.4 g of ferrous suffate heptahydrate, 320 ml water and 372 ml of 46° Baume ferric chloride solution. The mixture was stirred until the iron salt was in solution. In a 4-liter beaker was placed 320 ml water and 500 ml of 26° Baume ammonia solution. The mixture was stirred and the iron salts were added slowly. The beaker was topped with cold water, stirred and settled on a magnet. The supernatant liquid was siphoned off, the beaker refilled with cold water, stirred and again allowed to settle on a magnet. This process was repeated, until the ammonium salt content was less than 0.4 g.

Water was then added to a volume of 3000 ml, and 90 ml of oleic acid were added. The slurry was stirred for 1 hour at ambient temperature. The coated magnetite was settled on a magnet, siphoned down to a 1000 ml volume and washed three times by decantation with acetone.

2 liters of heptane were then added and the acetone wet slurry was stirred and heated until the acetone was evaporated. A total of 50 ml of a trimellitate ester and 50 ml of an acid phosphate ester of an ethoxylated alcohol (Dextrol OC-70) were added. The slurry was heated at 150° C. to 160° C., until the heptane and residual water had evaporated. The ferrofluid had a magnetization of 701 gauss and a viscosity of 27° C. of about 450–500 cps.

EXAMPLE 5

Use of phosphoric acid esterof an ethyoxylated alcohol in excess as a dispersant for oleic-acid-coated magnetite In a shallow pan, a volume of 900 ml of a stable colloidal suspension of oleic acid coated magnetite particles in heptane with a saturation magnetization of 270 gauss was diluted with an equal volume of acetone and the precipitated particles were collected on a magnet. The supernatant liquid was siphoned off and the particles washed with a two liter volume of acetone. A quantity of 125 g. of Dextrol OC-70 dissolved in xylene to make a liter of solution was added to the particles and the mixture was heated to 90° C. and stirred to evaporate acetone and xylene. The dry, sticky residue was extracted consecutively with one liter portions of acetone until the acetone extracts were no longer colored red by the presence of dissolved iron salts of Dextrol OC-70 and the excess dispersant was removed.

A liter of xylene was added and the suspension was heated and stirred at 90° C. to evaporate acetone and xylene. Portions of a 6.10 trimellitate ester (USS Chemicals PX-336) were added as the xylene was evaporated to produce a stable colloidal suspension of dispersed magnetite, the saturation magnetization being adjusted to 450 gauss by addition of the carrier liquid.

The colloidal suspension was refined on a magnet in a 90° C. oven for about 24 hours, then filtered. The finished material had a saturation magnetization of 453 gauss and a viscosity of 295 centipoise.

EXAMPLE 6

Use of an acid phosphoric acid ester of a fatty alcohol as a dispersant for isostearic acid coated magnetite in nonpolar synthetic hydrocarbon oils.

In a shallow pan was placed one liter of a stable colloidal suspension of isostearic acid coated magnetite particles in heptane with a saturation magnetization of 220 gauss and it was diluted with an equal volume of acetone. The precipitated particles were collected over a magnet placed under the pan and the liquid was siphoned off. The particles were washed once with two liters of acetone. A quantity of 100 g. of RB-400 (a phosphate fatty alcohol ester, e.g., a stearyl alcohol-GAF Corp.) was weighed into the pan with the particles and one liter of xylene was added. The mixture was heated to 90° C. and stirred to drive off acetone and evaporate xylene. When the volume of liquid was reduced to less than about 200 ml, a total of about two liters of acetone was added with stirring and the particles were collected on a magnet placed under the shallow pan. The liquid, red in color, was siphoned off and the particles were washed once with two liters of acetone to ensure removal of the excess dispersant.

A volume of one liter of xylene was added to the particles and the mixture was heated with stirring to 90° C. to evaporate acetone and xylene. As the xylene evaporated portions of Emery Co. 3006 poly (polyalphaolefin) lubricant oil was added to adjust the saturation magnetization to about 350 gauss.

The fluid was refined on a magnet in a 90° C. oven for about 24 hours and then it was filtered. The saturation magnetization of the stable colloidal suspension was 338 gauss and the viscosity was 121 centipoise.

What I claim is:

1. A stable ferrofluid composition, which composition comprises a colloidal dispersion of finely-divided magnetic particles in a liquid carrier and a dispersing amount of a dispersing agent, which agent comprises an acid phosphoric acid ester of a long-chain alcohol, the long-chain alcohol compatible with the liquid polar carrier.

2. The composition of claim 1 wherein the dispersing agent comprises from about 1:1 to 20:1 by volume of the magnetic particles.

3. The composition of claim 1 wherein the magnetic particles are activated magnetite particles.

4. The composition of claim 1 wherein the composition has a viscosity of from about 50 to 2000 cps.

5. The composition of claim 1 wherein the magnetic particles comprise from about 1% to 10% by volume of the composition.

6. The composition of claim 1 wherein the magnetic particles have an average particle size of from about 20 to 500 Angstroms.

7. The composition of claim 1 wherein the composition has a gauss of from about 200 to 775.

8. The composition of claim 1 wherein the dispersing agent comprises a monophosphate or diphosphate ester of a $C_6$–$C_{12}$ aliphatic alcohol.

9. The composition of claim 1 wherein the dispersing agent comprises a monophosphate or diphosphate ester of a $C_2$–$C_3$ alkoxylated aliphatic alcohol.

10. The composition of claim 1 wherein the dispersing agent comprises the monophosphate or diphosphate acid ester of an ethoxylated alkanol.

11. The composition of claim 1 wherein the dispersing agent comprises a phosphate acid ester of an ethoxylated $C_8$–$C_{10}$ alkylated phenol.

12. The composition of claim 1 wherein the magnetic particles are coated with a dispersant which is compatible with a nonpolar organic liquid carrier.

13. The composition of claim 12 wherein the dispersant comprises a fatty acid.

14. The composition of claim 1 wherein the dispersing agent comprises a phosphate acid ester of a nonylphenol polyethyleneoxy ethanol.

15. The composition of claim 1 wherein the liquid carrier is a liquid polar carrier and comprises an organic polyester or a trimellitate ester.

16. The composition of claim 15 wherein the liquid organic polar carrier comprises a diester or triester of adipic, citric, azeleic, phthalic or trimellitic acid.

17. The composition of claim 1 wherein the dispersing agent comprises a phosphate acid ester of a $C_8$–$C_{20}$ fatty alcohol.

18. The composition of claim 1 wherein the liquid carrier is a nonpolar liquid carrier which comprises a alphaolefinic oil.

19. The composition of claim 1 wherein the dispersing agent is present in an excess of from about 10 to 90 percent by weight over the stoichiometric dispersing amount of the dispersing agent.

20. The composition of claim 1 wherein the ferrofluid composition is characterized by being essentially free of magnetic particles having a diameter of about 60 Angstroms or less.

21. A stable ferrofluid composition, which composition comprises a colloidal dispersion of finely-divided magnetite particles in an organic liquid polar carrier and a dispersing amount of a dispersing agent, which dispersing agent comprises an acid phosphoric acid ester of a $C_2$–$C_3$ alkoxylated alcohol.

22. The composition of claim 21 wherein the dispersing agent comprises a phosphoric acid ester of an ethoxylated aliphatic linear alcohol.

23. The composition of claim 21 wherein the dispersing agent comprises a phosphoric acid ester of a nonylphenoxy polyethyleneoxy ethanol.

24. The composition of claim 21 which includes a dispersant coated onto the magnetite particles, the dispersant comprising a fatty acid.

25. The composition of claim 24 wherein the composition has a minimum viscosity of 50 cps and has a gauss of from about 50 to 775.

26. A stable ferrofluid composition, which composition comprises a colloidal dispersion of finely-divided magnetic particles in a nonpolar liquid carrier and a dispersing amount of a dispersing agent which dispersing agent comprises an acid phosphoric acid ester of a $C_8$–$C_{20}$ fatty alcohol.

27. The composition of claim 26 which includes a dispersant coated onto the magnetite particles, the dispersant comprising a fatty acid.

28. The composition of claim 26 wherein the nonpolar liquid carrier comprises an alphaolefinic oil.

29. The composition of claim 26 wherein the dispersing agent comprises an acid phosphoric acid ester of a stearyl alcohol.

* * * * *